US012037872B2

(12) United States Patent
Hiorth

(10) Patent No.: US 12,037,872 B2
(45) Date of Patent: Jul. 16, 2024

(54) WELL TOOL DEVICE

(71) Applicant: Interwell Norway AS, Hafrsfjord (NO)

(72) Inventor: Espen Hiorth, Trondheim (NO)

(73) Assignee: Interwell Norway AS, Hafrsfjord (NO)

( * ) Notice: Subject to any disclaimer, the term of this patent is extended or adjusted under 35 U.S.C. 154(b) by 178 days.

(21) Appl. No.: 17/630,460

(22) PCT Filed: Aug. 14, 2020

(86) PCT No.: PCT/EP2020/072907
§ 371 (c)(1),
(2) Date: Jan. 26, 2022

(87) PCT Pub. No.: WO2021/032642
PCT Pub. Date: Feb. 25, 2021

(65) Prior Publication Data

US 2022/0251922 A1 Aug. 11, 2022

(30) Foreign Application Priority Data

Aug. 22, 2019 (NO) ..... 20191006

(51) Int. Cl.
*E21B 34/10* (2006.01)
*E21B 33/12* (2006.01)
*E21B 34/06* (2006.01)

(52) U.S. Cl.
CPC ..... *E21B 34/063* (2013.01); *E21B 33/1208* (2013.01); *E21B 34/103* (2013.01); *E21B 2200/06* (2020.05)

(58) Field of Classification Search
CPC ..... E21B 34/063; E21B 34/101
See application file for complete search history.

(56) References Cited

U.S. PATENT DOCUMENTS 3,910,348 A 10/1975 Pitts
4,773,478 A 9/1988 Streich
(Continued)

FOREIGN PATENT DOCUMENTS

NO 20141157 A1 * 5/2018 ..... E21B 34/14
WO 2014/154464 A2 10/2014
(Continued)

OTHER PUBLICATIONS

International Search Report issued in PCT/EP2020/072907 on Oct. 2, 2020 (4 pages).
(Continued)

*Primary Examiner* — Blake Michener
(74) *Attorney, Agent, or Firm* — Osha Bergman Watanabe & Burton LLP

(57) ABSTRACT

A well tool device includes a housing; a through bore provided axially through the well tool device; and a frangible disc supported in the through bore by a first supporting device and a second supporting device. The through bore is defined with a bore wall. The second supporting device is axially displaceable in relation to the first supporting device. The well tool includes a shear element for preventing axial displacement of the second supporting device; a sealing element arranged radially outside of the frangible disc and radially inside of the bore wall when the well tool device is in a first state, in which the sealing element together with the frangible disc is configured to prevent axial fluid flow between a first side of the frangible disc and a second side of the frangible disc; and a disintegration device. The well tool device is configured to be in a second state, in which the shear element has been sheared off and the frangible disc and the second supporting device have been moved axially until the frangible disc has been brought into contact with the disintegration device. The well tool device is configured to
(Continued)

be in a third state, in which the frangible disc has been disintegrated by means of the disintegration device. The well tool device includes a flushing channel provided in the bore wall radially outside of the frangible disc when the well tool device is in the second state.

9 Claims, 8 Drawing Sheets

(56) References Cited

U.S. PATENT DOCUMENTS

| | | | | |
|---|---|---|---|---|
| 5,479,986 | A * | 1/1996 | Gano | E21B 34/10 166/292 |
| 6,119,783 | A * | 9/2000 | Parker | E21B 34/10 166/135 |
| 11,332,999 | B1 * | 5/2022 | Eriksen | E21B 33/1208 |
| 2016/0060998 | A1 * | 3/2016 | Hiorth | E21B 33/12 166/192 |
| 2019/0017345 | A1 * | 1/2019 | Brandsdal | E21B 34/063 |
| 2019/0032448 | A1 * | 1/2019 | Bjørgum | E21B 34/063 |
| 2020/0115989 | A1 * | 4/2020 | Hiorth | E21B 34/063 |
| 2021/0040816 | A1 * | 2/2021 | Hiorth | E21B 34/063 |

FOREIGN PATENT DOCUMENTS

| | | | |
|---|---|---|---|
| WO | 336554 | B1 | 9/2015 |
| WO | 20160233 | A1 | 6/2016 |
| WO | 338780 | B1 | 10/2016 |
| WO | 2017/137559 | A1 | 8/2017 |
| WO | 20171157 | A1 | 5/2018 |
| WO | 20180579 | A1 | 5/2018 |
| WO | 342911 | B1 | 8/2018 |
| WO | 2019/011563 | A1 | 1/2019 |

OTHER PUBLICATIONS

Written Opinion of the International Searching Authority issued in PCT/EP2020/072907 on Oct. 2, 2020 (9 pages).

Norwegian Search Report issued in No. 20191006 mailed on Mar. 16, 2020 (2 pages).

* cited by examiner

WELL TOOL DEVICE

FIELD OF THE INVENTION

The present invention relates to a well tool device. The well tool device may be connected to a completion string in an oil and/or gas well. The well tool device may also be used in a well plug.

BACKGROUND OF THE INVENTION

A completion operation is an operation where a completion string or production tubing is installed in a hydrocarbon producing well. There are several requirements for such an operation, one of which is that the production tubing must be pressure tested in order to ensure that it can withstand a predetermined pressure threshold before hydrocarbon production is started.

During pressure testing, the lower part of completion string must be closed, to prevent fluid to enter the well or annulus outside of the completion string. It is known to use a frangible glass or ceramic disc to seal off the bore of the completion string. This frangible disc can withstand high pressures. After the pressure testing, it is should be relatively easy to disintegrate the frangible disc in order to start production through the bore of the completion string.

There are many principles known for disintegration of such frangible discs, among which is the use of explosives, moving a spear into the disc, displacing the disc axially into knives or other sharp objects fixed in the pipe wall etc.

A well tool device which is initially closed, but is opened by increase of the pressure above the well tool device is often referred to as a pump open sub.

NO 342911 describes a completion pipe comprising a plug arrangement and a method for arranging a completion pipe in a well. The arrangement includes a disintegratable plug element (disc) arranged in a plug housing in a pipe string, a seal element arranged to seal between the plug element and the pipe string. The plug element is movable in the axial direction of the pipe string between a first position and a second position, wherein this second position, the disc is brought into contact with a knife.

Here, it is desired that the sealing element (typically an o-ring) is sealing off the circumferential surface of the disc, i.e. the between the disc and the surrounding the disc housing in both the first and second position, in order to use the pressure above the disc to push the disc downwardly into the knives.

Moreover, a shear element in the form of a shear ring or shear sleeve is used to support the disc in the first position during the pressure testing. Then, the pressure is increased further, causing the shear sleeve or shear ring to shear off, thereby allowing the disc, together with parts of the shear sleeve or shear ring, to be displaced axially into the second position.

It is well known to use such shear rings in well tool devices. U.S. Pat. No. 3,910,348 discloses shear rings, while U.S. Pat. No. 4,773,478 discloses a shear sleeve. In addition, it is also known to use shear pins to provide that two different parts are allowed to move in relation to each other when a certain pressure threshold sufficient to shear of the pins are achieved.

Also NO 336554 (Vosstech AS—now a part of Interwell Norway AS) discloses axial displacement of a glass disc towards knifes. Here, the axial displacement can be initiated by shear elements being sheared off. Alternatively, the axial displacement can be initiated a predetermined number of pressure cycles, for example by an actuating mechanism disclosed in NO 338780 Also here, o-rings are sealing off the circumference of the disc in the first (initial) position and in the position where the disc has been displaced into contact with the knives.

Interwell has developed a method, disclosed in NO 20160233, for hardening this type of glass disc, where the hardening process results in large compressive residual stresses in the glass—a principle known from Prince Rupert's drops. The glass disc can withstand high pressures—but as soon as the surface of the glass becomes damaged by means of the knives, the entire glass disc will disintegrate or shatter into small glass particles.

One disadvantage with the above prior art is that the knife itself may become damaged due to the contact with the glass. This will not represent a problem if only one glass disc is used. However, if two or more glass discs are used, then there is a risk that the second or third disk will not be disintegrated due to a blunt or damaged knife.

Hence, one object of the present invention is to prevent or reduce damage to the knife.

Another object is to prevent glass pieces or glass particles to obstruct the contact between the knife and the glass disc. Again, this may occur if two or more glass discs are used, or if one glass disc of a tougher glass type is used. During the initial phase of the disintegration process, there is a volume increase of the glass disc due to the cracks in the glass disc. Hence, it is considered an advantage if the glass disc has an expansion volume available.

This type of well tool devices may have other applications as well. They can be integrated into well plugs, for pressure alignment between the upper and lower side of the well plug. This also makes it possible to remove debris by allowing fluid flow through the plug. Pressure alignment and debris removal are both processes which simplifies retrieval of the well plug from the well.

SUMMARY OF THE INVENTION

The present invention relates to a well tool device comprising:

- a housing;
- a through bore provided axially through the well tool device; where the through bore is defined with a bore wall;
- a frangible disc supported in the through bore by a first supporting device and a second supporting device, where the second supporting device is axially displaceable in relation to the first supporting device;
- a shear element for preventing axial displacement of the second supporting device;
- a sealing element arranged radially outside of the frangible disc and radially inside of the bore wall when the well tool device is in a first state, in which the sealing element together with the frangible disc is configured to prevent axial fluid flow between a first side of the frangible disc and a second side of the frangible disc;
- a disintegration device;

where the well tool device is configured to be in a second state, in which the shear element has been sheared off and the frangible disc and the second supporting device have been moved axially until the frangible disc has been brought into contact with the disintegration device;

where the well tool device is configured to be in a third state, in which the frangible disc has been disintegrated by means of the disintegration device; characterized in that the well tool device further comprises:

a flushing channel provided in the bore wall radially outside of the frangible disc when the well tool device is in the second state.

The flushing channel is configured to allow an axial fluid flow between a first side of the frangible disc and a second side of the frangible disc. The frangible disc is considered to be intact in the second state.

In one aspect, the shear element will shear off when a predetermined pressure difference threshold between the first side and the second side of the frangible disc is achieved. Preferably, this predetermined pressure difference between the first side and the second side of the frangible disc is positive, i.e. the shear element is sheared off when the pressure is higher on the first side than on the second side. The first side is preferably the upper side, while the second side is the lower side.

Due to this pressure difference threshold, the frangible disc will also push the second supporting device towards the second side as soon as the shear element has been sheared off.

The flushing channel also allows for a small volume increase of the glass disc during disintegration.

Here, the fluid flow created by the flushing channel will also contribute to remove any disc fragments from the disintegration device. Moreover, this will also reduce wear of the disintegration device. This may be of importance if the well tool device comprises several adjacent frangible discs.

In one aspect, the disintegration device comprises a knife section with a first, chamfered cutting edge and a second, axial cutting edge.

In one aspect, the flushing channel is provided as at least one recess or groove in the bore wall.

In one aspect, the at least one recess or groove is axially aligned with the disintegration device.

Alternatively, the flushing channel can be provided as a radial expansion of the axial through bore. Here, one or several disintegration devices are distributed circumferentially in the radial expansion of the through bore.

In one aspect, the frangible disc is axially displaced to a position in which the sealing element is out of engagement with the frangible disc when the well tool device is in the second state.

In one aspect, further axial movement of the second supporting device is prevented when the well tool device is in the third state.

In one aspect, further axial movement of the second supporting device in the third state is prevented when an inner element of the shear element is provided axially between, and in contact with, a first stop and a first receiving area.

In one aspect, further axial movement of the second supporting device in the third state is prevented when a second stop is provided in contact with a second receiving area.

In one aspect, the second supporting device is provided as part of an axially displaceable sleeve comprising a supporting surface for contact with the disc.

In one aspect, the sleeve comprises the first stop and the second stop.

As used herein, the terms "upper", "above", "below" and "lower" are used herein to define positions in a well. "Upper" and "above" refer to a position relatively closer to the wellhead and "below" and "lower" refer to a position relatively further away from the wellhead. These terms apply both when the well has a vertical and horizontal orientation.

As used herein, term "frangible disc" refers to a disc made of glass material, a ceramic material etc, which may be disintegrated by applying a mechanical force to the disc. Hence, "frangible disc" does not refer to discs that are chemically dissolved by contact with a fluid such as water or another fluid. Preferably, the frangible disc is made of hardened glass.

DETAILED DESCRIPTION

Embodiments of the present invention will be described in detail below with reference to the enclosed drawings, where:

Figure 5B:
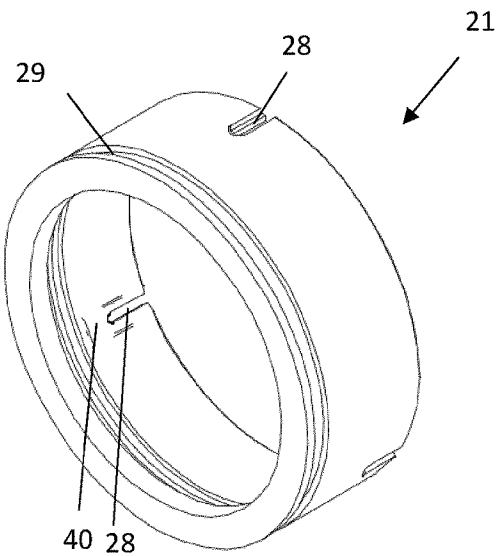
Figure 5A:
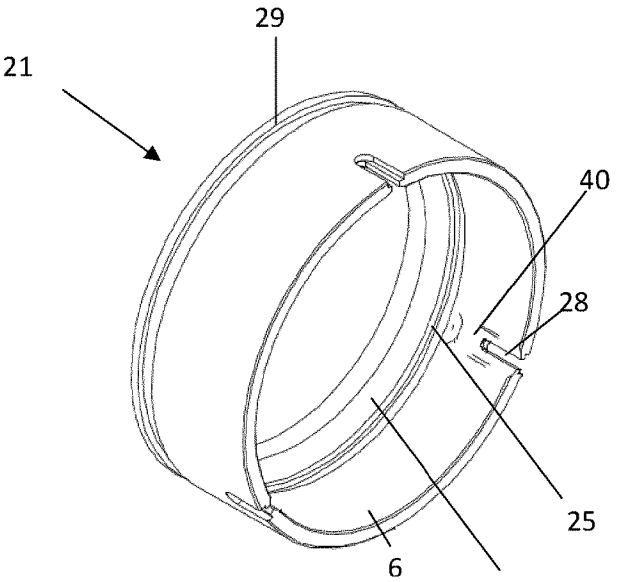
Figure 6B:
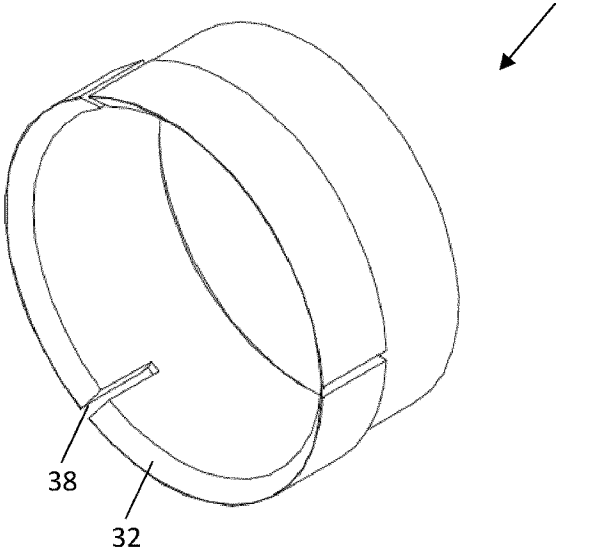
Figure 6A:
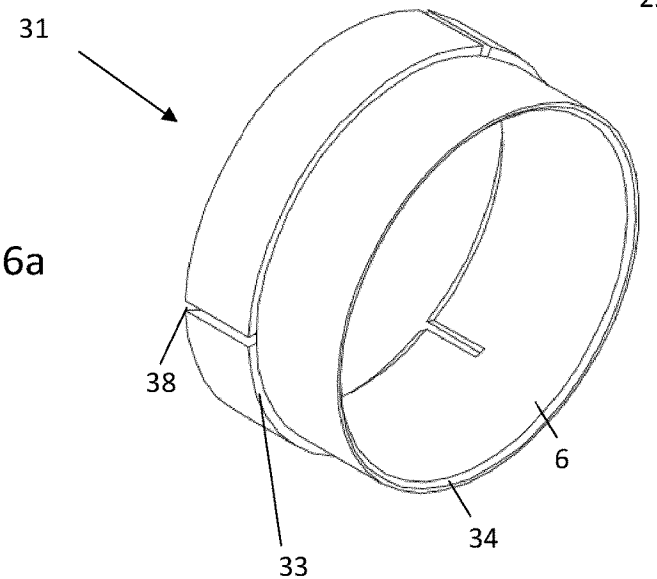
Figure 7B:
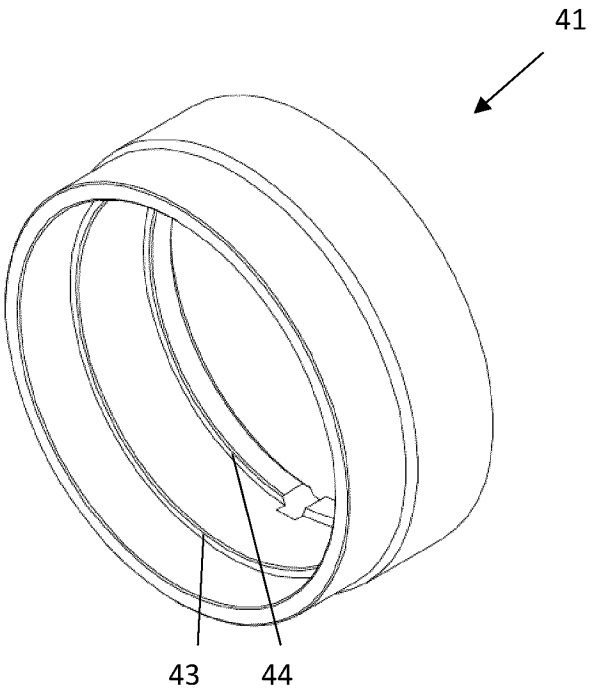
Figure 7A:
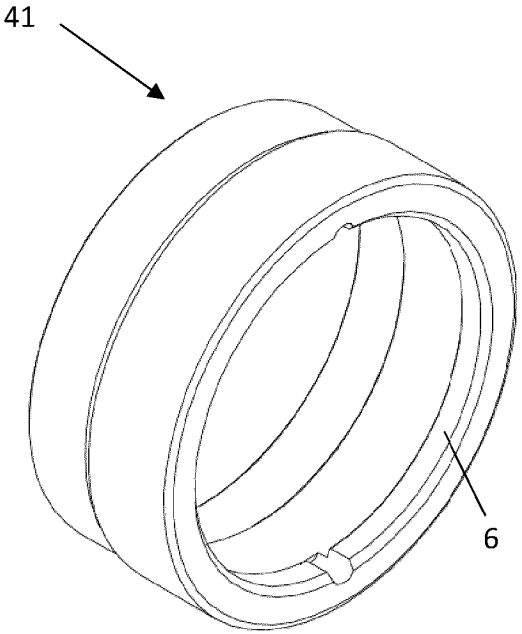
Figure 9:
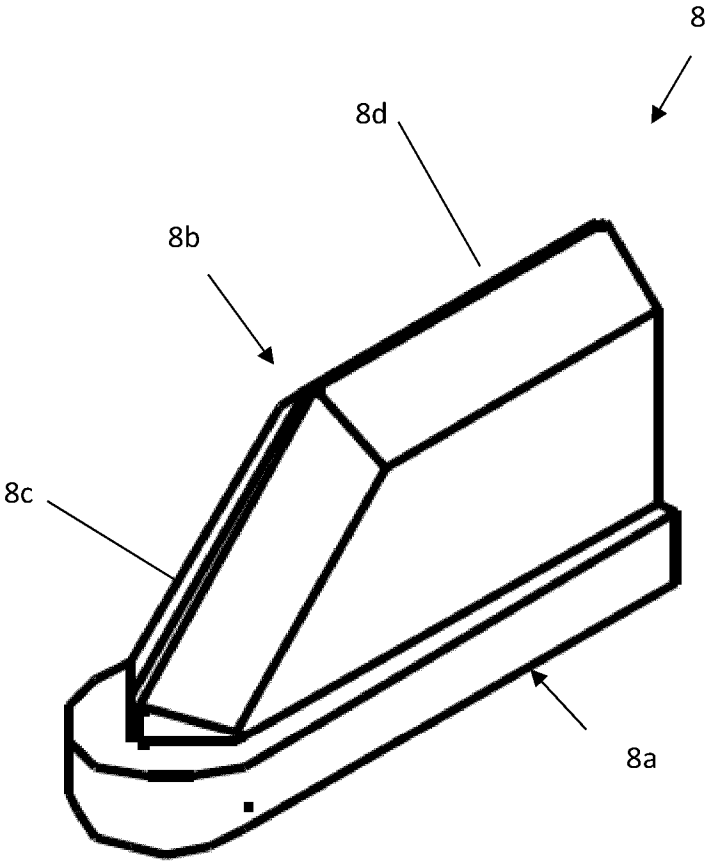
Figure 8:
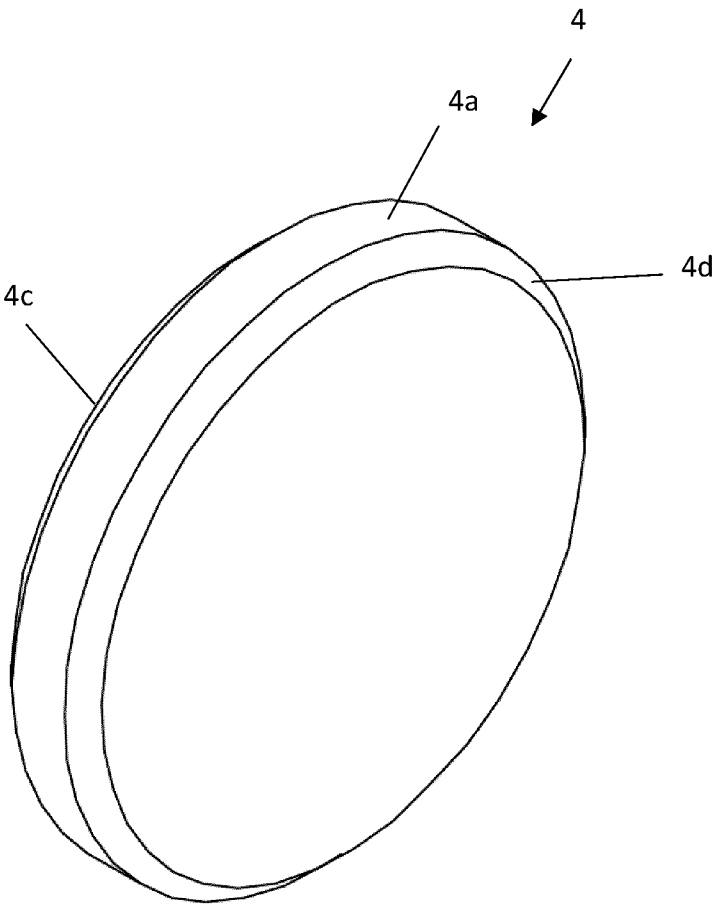

FIGS. 5*a* and 5*b* illustrate perspective views of the first supporting sleeve of the sleeve assembly;

FIGS. 6*a* and 6*b* illustrate perspective views of the second supporting sleeve of the sleeve assembly;

FIGS. 7*a* and 7*b* illustrate perspective views of the third supporting sleeve of the sleeve assembly;

FIG. 8 illustrates a perspective view of the frangible disc;

FIG. 9 illustrates an enlarged perspective view of the disintegration device.

Figure 1:
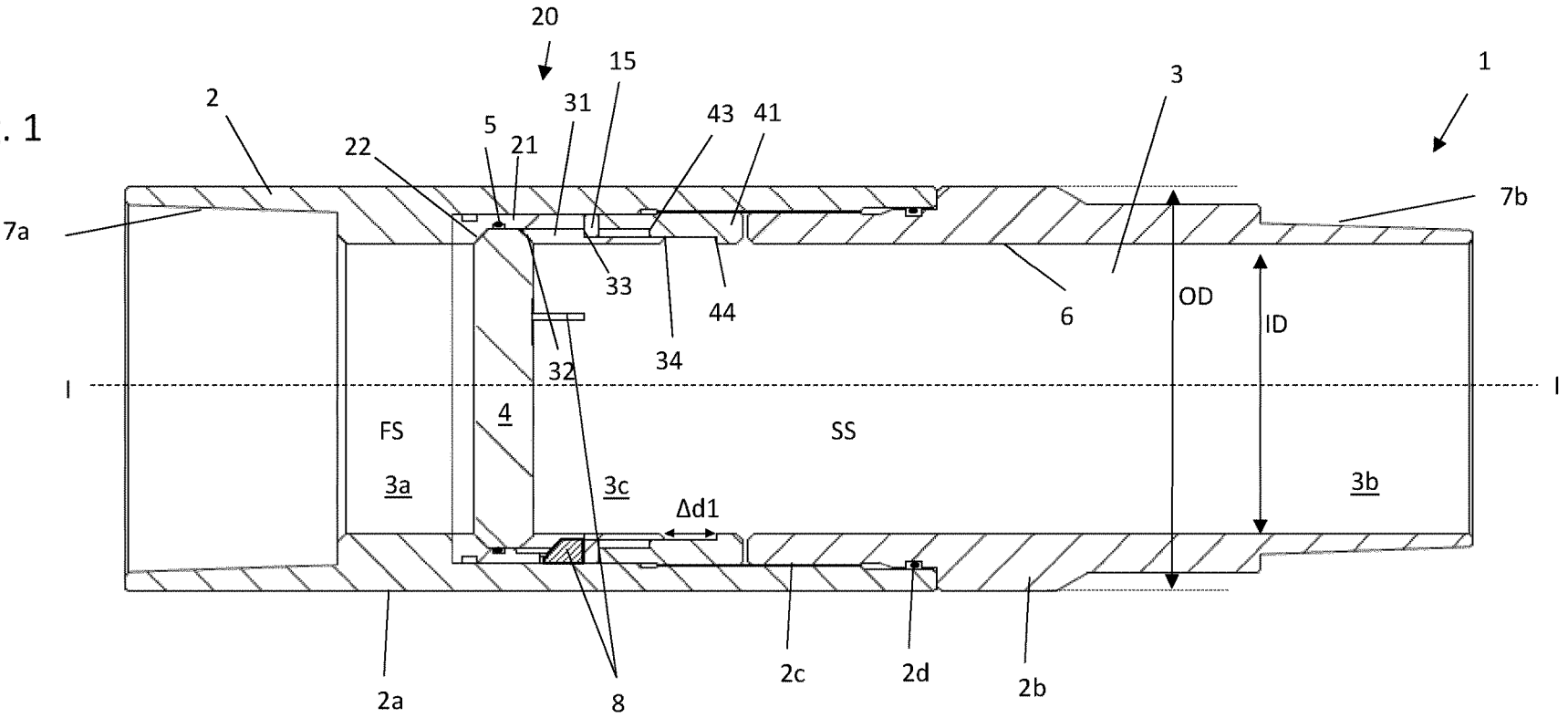
FIG. 1 illustrates a cross sectional view of the well tool device in its first or initial state.
Figure 3:
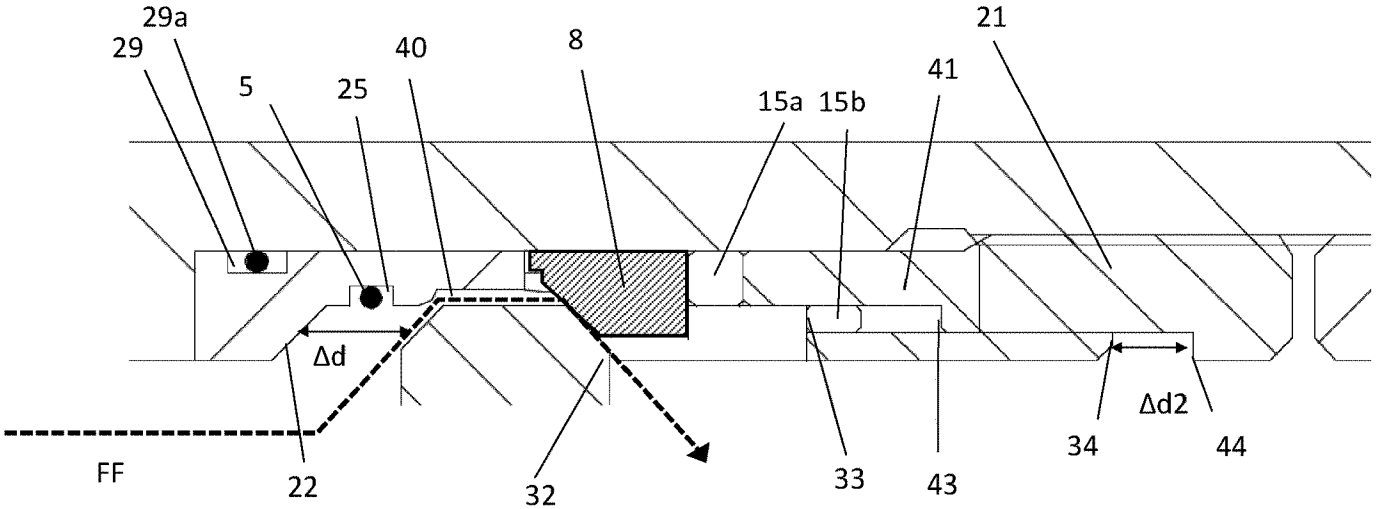
FIG. 3 illustrates an enlarged view of the dashed box DB in FIG. 2.
Figures 10, 11, 12:
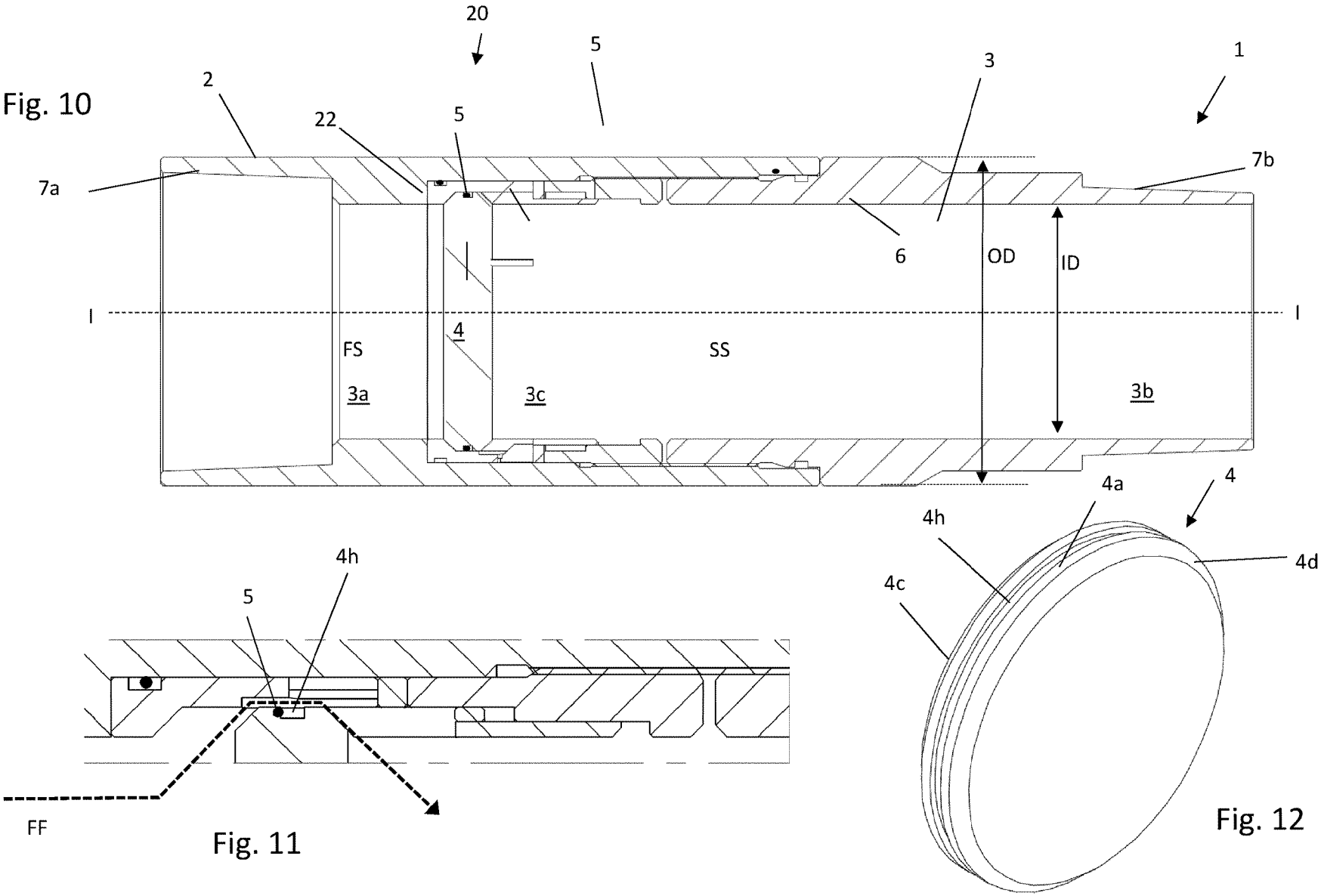
Figure 13B:
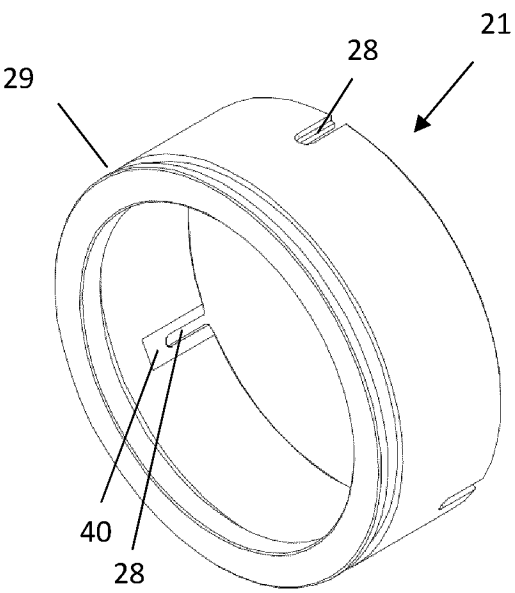
Figure 13A:
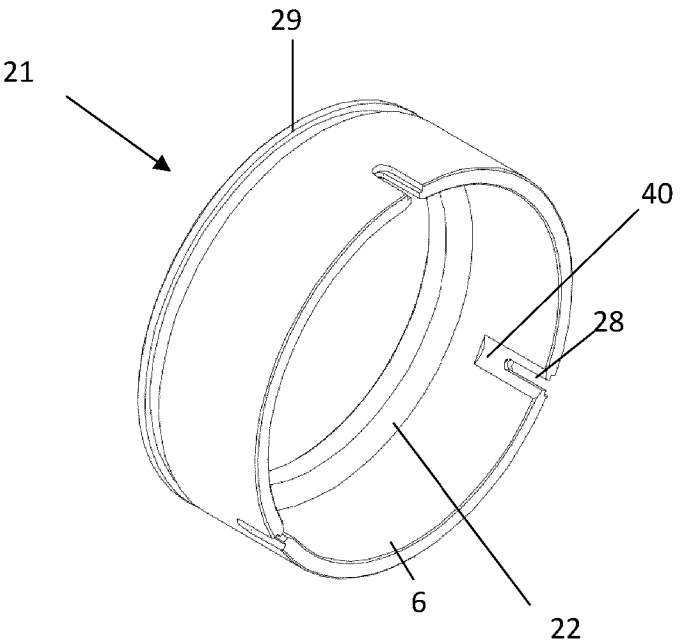

FIGS. 10, 11 and 12 illustrates a second embodiment, where FIG. 10 corresponds to FIG. 1, FIG. 11 corresponds to FIG. 3 and FIG. 12 corresponds to FIG. 8;

FIGS. 13*a* and 13*b* illustrates perspective vies of a second embodiment of the first supporting sleeve.

It is now referred to FIG. 1. Here, a well tool device 1 is shown. The well tool device 1 comprises a housing 2, comprising a first housing section 2*a* and a second housing section 2*b*. The first housing section 2*a* is here the upper housing section, i.e. relatively closer to the wellhead according to the above definitions, while the second housing section 2*b* is the lower housing section. The housing sections 2*a*, 2*b* are connected to each other by means of a threaded joint 2*c*. A sealing element 2*d* is provided adjacent to the threaded joint 2*c* to prevent fluid flow via the joint.

The present embodiment is a so-called "sub", i.e. it is provided as part of a pipe string (not shown). Hence, the housing 2 comprises an upper connection interface 7*a* and a lower connection interface 7*b* for connection to pipe sections of the pipe string. The pipe string may be a completion string or another type of pipe string.

A bore 3 is provided axially through the well tool device 1. The axial direction is indicated with the center axis I-I in FIG. 1. The through bore 3 is defined with a bore wall 6, allowing fluid flow through the device 1.

The well tool device 1 further comprises a frangible disc 4 supported in the through bore 3 by means of a sleeve assembly 20. The frangible disc 4 is shown in FIG. 8 and comprises a cylindrical outer surface 4*a* and upper and lower chamfered supporting surfaces 4*c*, 4*d*. The frangible disc 4 prevents axial fluid flow through the device 1 between a first side FS of the frangible disc 4 and a second side SS of the frangible disc 4. The chamfered supporting surfaces 4*c*, 4*d* are used to transfer forces caused by differential fluid pressure over the disc 4 to the housing 2.

The well tool device 1 is configured to be in an initial or first state, in which axial fluid flow through the bore 3 is prevented by the frangible disc 4. The well tool device 1 is further configured to be in a final or third state, in which axial fluid flow through the bore 3 is allowed. Here, in the final state, the frangible disc 4 has been disintegrated or broken into smaller fragments and is hence no longer supported in relation to the housing 2. An intermediate or second state after the initial state but before the final state will also be described further below.

The well tool device 1 comprises a first supporting device 22 configured to be in contact with the first chamfered supporting surface 4*c* and a second supporting device 32 configured to be in contact with the second chamfered supporting surface 4*d* when the well tool device 1 is in its initial state. The second supporting device 32 is axially displaceable in relation to the first supporting device 22, to allow axial movements of the frangible disc 4 towards a disintegration device 8, thereby allowing disintegration of the frangible disc 4 and hence allow the device 1 to get into its final state. This will be described in detail below.

The disintegration device 8 is shown in FIG. 9. Here, it is shown that the disintegration device 8 comprises a base section 8*a* for supporting the device 8 in relation to the housing 2. The disintegration device 8 further comprises a knife section 8*b* with a first, chamfered cutting edge 8*c* and a second, axial cutting edge 8*d*. The knife section 8*b* protrudes into the bore 3, to enable contact between the knife section 8*b* and the frangible disc 4. In the present embodiment, the well tool device 1 comprises three disintegration devices 8. It should be noted that there can be one, two or more than three such disintegration devices 8.

The present embodiment of the well tool device 1 further comprises a sleeve assembly 20, comprising a first supporting sleeve 21, a second supporting sleeve 31 and a third supporting sleeve 41, which will be described in detail below. The sleeve assembly 20 is provided radially inside the housing 2, where the bore 3 is continued through the sleeve assembly. Hence, the bore 3 can be considered to comprise a first bore section 3*a* through the first housing section 2*a*, a second bore section 3*b* through the second housing section 2*b* and an intermediate bore section 3*c* through the sleeve assembly 20. The sleeve assembly 20 is preferably located in a recess in the housing 2, to ensure that an inner diameter ID of the through bore 3 is substantially equal through the well tool device 1.

It should be noted that a sealing element 5 is arranged radially outside of the frangible disc 4 and radially inside of the bore wall 6 when the well tool device 1 is in the initial state, where the sealing element 5 together with the frangible disc 4 is configured to prevent axial fluid flow.

The first supporting sleeve 21 will now be described with reference to FIG. 1 and FIGS. 5*a* and 5*b*. The first supporting sleeve 21 is fixed in relation to the housing 2. The first supporting device 22 is provided as a chamfered surface on the first supporting sleeve 21 as shown in FIG. 1 and FIG. 5*a*, for contact with the chamfered surface 4*c* of the disc 4. The first supporting sleeve 21 also comprises an inner recess 25 for the O-ring 5 described above and an outer recess 29 for an outer O-ring 29*a* (FIG. 3) for preventing fluid flow radially outside of the sleeve assembly 20. The first supporting sleeve 21 further comprises three slots 28 in which the above described disintegration devices 8 are provided.

The second supporting sleeve 31 will now be described with reference to FIG. 1 and FIGS. 6*a* and 6*b*. The second supporting sleeve 31 is axially displaceable in relation to the first supporting sleeve 21 and hence is also axially displaceable in relation to the housing 2. The second supporting device 32 is provided as a chamfered surface on the second supporting sleeve 31, as shown in FIG. 1 and FIG. 6*b*, for contact with the chamfered surface 4*d* of the disc 4. The first second supporting sleeve 31 further comprises a first stop 33 and a second stop 34, where the purpose of these stops 33, 34 is to stop the axial displacement of the second supporting sleeve 31. The first stop 33 is provided as a ring-shaped edge on the outer circumference of the second supporting sleeve 31, while the second stop 34 is provided as a lower end surface of the second supporting sleeve 31. The second supporting sleeve 31 further comprises three slots 38 in which the above described disintegration devices 8 are provided.

The third supporting sleeve 41 will now be described with reference to FIG. 1 and FIGS. 7*a* and 7*b*. The third supporting sleeve 41 is fixed in relation to the housing 2 and comprises a first receiving area 43 adapted to receive the first stop 33 and a second receiving area 44 adapted to receive the second stop 34 and hence stop the axial movement of the second supporting sleeve 31.

The main purpose of the first supporting sleeve 21 is to support the disc 4, to provide a fluid seal against the housing 2 by means of the sealing element 29*a* and further to provide a fluid seal against the disc 4 by means of the sealing element 5 when the device 1 is in its initial state. In the final state, the supporting sleeve 21 forms a part of the bore 3, allowing axial fluid flow through the device 1.

The main purpose of the second supporting sleeve 31 is to support the disc 4 in the initial state and to allow the disc 4 to come into contact with the disintegration devices 8 when the device 1 in its intermediate state. In the final state, the second supporting sleeve 31 also forms a part of the bore 3, allowing axial fluid flow through the device 1.

As the above sleeves 21, 31, 41 forms a part of the bore 3, at least parts of the inner surfaces of the sleeves 21, 31, 41 is considered to be a part of the bore wall 6 of the well tool device 1.

The main purpose of the third supporting sleeve 41 is to support the first and second supporting devices 31, 41 and to stop the axial movement of the second supporting sleeve 31.

It should be noted that the above sleeve assembly can be implemented in many ways. As an example, the first supporting sleeve 31 is not essential, as the chamfered surface forming the first supporting device 22 may be provided as part of the housing 2, typically as a part of the upper housing section 2 a. Also the third supporting sleeve 41 is not essential, as the receiving areas 43, 44 may be provided as part of the lower housing section 2 b. However, these alternatives would require more advanced machining processes during manufacturing of the housing 2.

It is now referred to FIG. 1 again. Here it is shown that the well tool device 1 comprises a shear element 15 provided axially between the first and third supporting sleeves 21, 41. It is also shown that the shear element 15 is provided in contact with the first stop 33 of the second supporting sleeve 31. The shear element 15 is configured to prevent axial displacement of the second supporting device 32 when the device 1 is in the initial state. When a predetermined pressure difference over the disc 4 is achieved, the force applied by the disc 4 to the second supporting sleeve 31 and further via the stop 33 to the shear element 15 will be sufficient to shear off the shear element 15, thereby allowing axial movement of the disc 4 and the second supporting sleeve 31. In the present embodiment, the shear element 15 is a shear ring or shear sleeve. However, it should be noted that other shear elements such as shear pins can be used as well.

It is now referred to FIG. 3. Here it is shown that the first supporting sleeve 21 comprises a fluid channel 40 axially above the disintegration device 8. The channel 40 is configured to allow an axial fluid flow FF between a first side FS of the frangible disc 4 and a second side SS of the frangible disc 4 before the disc 4 has disintegrated and during the disintegration of the disc 4. The channel is hereinafter referred to as a flushing channel, as the fluid flow FF contributes to flushing away fragments of the disc during the disintegration of the disc. The channel 40 also allows for a small volume increase of the glass disc during disintegration.

The channel 40 may be provided as at a recess or groove in the bore wall 6 axially above each disintegration device 8 (as shown in FIG. 5*a-b* and 13*a-b* described below). Alternatively, the channel 40 can be provided as a radial expansion of the axial through bore 3, i.e. fluid flow FF will be allowed around the entire circumference of the disc 4, not only at the location of the disintegration devices 8.

The operation of the well tool device 1 will now be described with reference to FIG. 1-4.

The well tool device 1 is typically provided in the lower part of the completion string which is lowered into the well. The completion string is initially closed, due to the initial or first state of the well tool device 1 described above.

In FIG. 1, a first distance Δd1 is indicated as the maximum distance the second supporting sleeve will be allowed to move when the shear element 15 is sheared off.

The shearing of the shear element 15 is performed by applying a predetermined pressure difference threshold P over the frangible disc.

Figure 2:
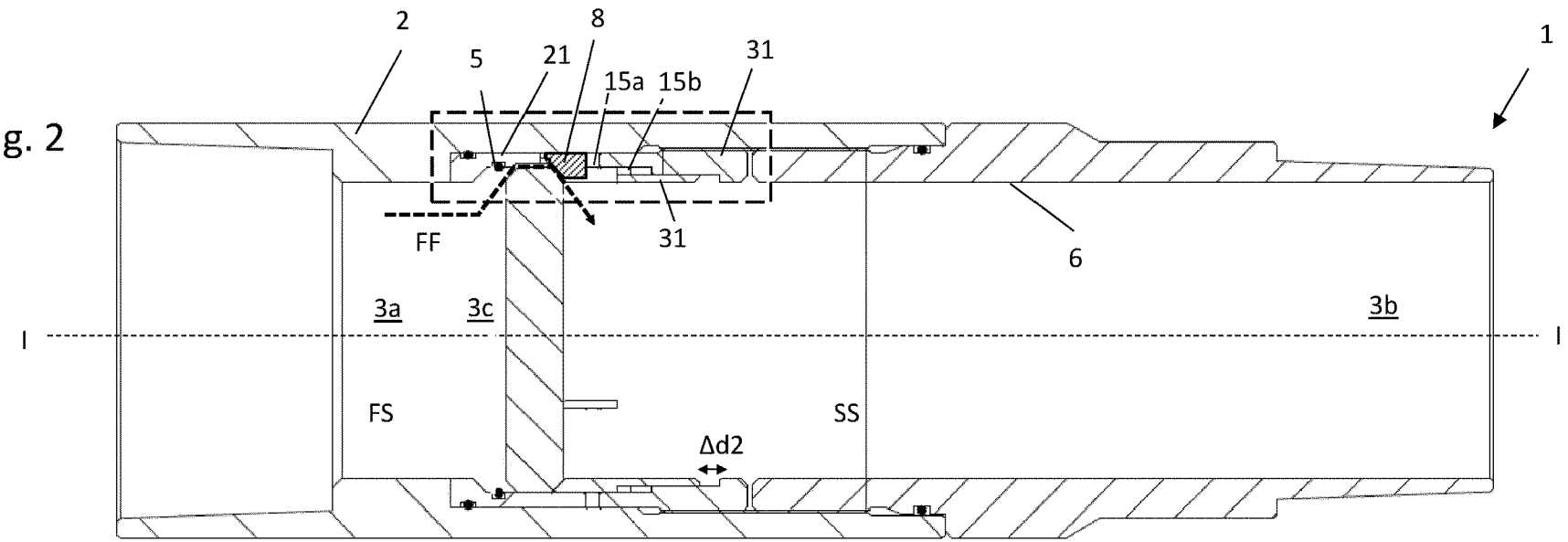
FIG. 2 illustrates cross sectional view of the well tool device in its second or intermediate state.

In FIGS. 2 and 3, it is shown that the shear element 15 has been sheared off and is now separated into an outer element 15*a* axially between the first and third supporting sleeves 21, 41 and an inner element 15*b* axially between the first stop 33 and the first receiving area 43. The outer element 15*a* is stationary, while the inner element 15*b* is axially displaceable together with the second supporting sleeve 31.

FIGS. 2 and 3 shows the intermediate or second state, which is a state in which the frangible disc 4 and the second supporting device 32 have been moved axially until the frangible disc 4 has been brought into contact with the disintegration device 8.

In this state, the sealing element 5 is out of engagement with the frangible disc 4. Hence, the sealing element 5 does not prevent axial fluid flow radially outside of the yet intact disc 4 via the channel 40.

Immediately after the frangible disc 4 has been brought into contact with the disintegration device 8, the disintegration device 8 will damage the frangible disc 4 and disintegration of the frangible disc 4 will start. In embodiments where the frangible disc 4 is made of hardened glass, it is predicted that the frangible disc 4 will be disintegrated into small glass particles within a few milliseconds. In embodiments where the frangible disc 4 is made of tougher materials, it is predicted that the frangible disc 4 will disintegrate somewhat slower.

In any case, the fluid flow FF through the channel 40 will contribute to separate the disc fragments from each other in the initial phase of the disintegration process. The fluid flow FF will also contribute to remove any disc fragments from the disintegration device 8. Moreover, this will also reduce wear of the disintegration device 8. This may be of importance if the well tool device 1 comprises several frangible discs 4.

In one aspect, the channel 40 has a cross sectional area which is much smaller than the cross sectional area of the bore 3. It should be noted that the cross sectional area of the flushing channel 40 is here defined as the area radially outside of the frangible disc 4 when the well tool device 1 is in the second state, i.e. while the disc is yet intact. The cross sectional area of the channel 40 can be 0.5-5% of the cross sectional area of the through bore 3.

Due to the above pressure difference threshold, and due to the above relatively smaller cross sectional area of the flushing channel 40, the fluid flow FF through the channel 40 will have a high velocity. Consequently, a nozzle effect is achieved.

As shown in FIGS. 2 and 3, the second supporting sleeve 31 is still allowed to move a further distance Δd2, to ensure that the frangible disc 4 becomes disintegrated.

Figure 4:
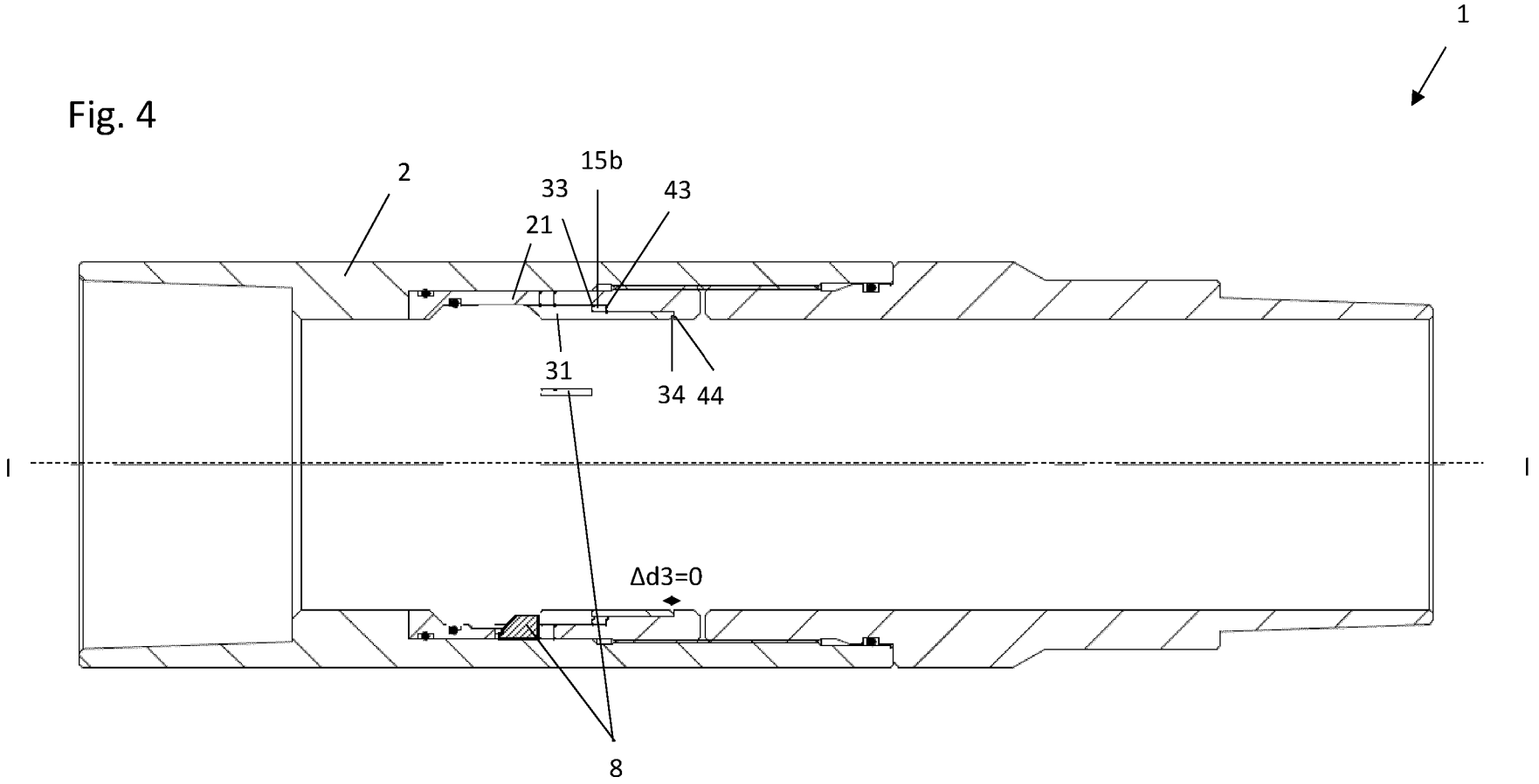
FIG. 4 illustrates a cross sectional view of the well tool device in its third or final state.

It is now referred to FIG. 4, where the third or final state is shown. Here, the second supporting sleeve 31 has been moved until the second stop 34 is in contact with the second receiving area 44. It should be noted that the first stop 33 will not get directly into contact with the first receiving area 43, as the inner element 15*b* is provided axially between the stop 33 and the area 43. However, also the engagement between stop 33, the area 43 and the inner element 15*b* will prevent further axial movement of the second supporting sleeve 31. As indicated in FIG. 4, the distance Δd3=0, i.e. no further axial movement is possible.

Second Embodiment

It is now referred to FIG. 10, 11 12 and FIG. 13*a-b*. The second embodiment corresponds substantially to the first embodiment described above, and only differences will be described here.

The main difference is that in the second embodiment, the sealing element 5 radially outside of the disc 4 is not provided in a recess 25 in the housing or sleeve assembly 20. Instead, the sealing element 5 is provided in a recess 4*h* in the disc 4. Hence, the sealing element 5 will move axially together with the disc from the initial or first state (FIG. 10) to the intermediate or second state (FIG. 11). It should be noted that due to the flushing channel 40 provided in the bore wall 6 radially outside of the frangible disc 4 when the well tool device 1 is in the second state, fluid flow FF, flushing will occur also in this embodiment, as indicated with dashed arrow FF in FIG. 11. It is believed that a smaller outer diameter OD of the housing 2 and/or a larger inner diameter ID of the bore 3 can be achieved with this embodiment.

ALTERNATIVE EMBODIMENTS

It should be noted that the above well tool device 1 can have other usages than a pump open sub in a completion string. It can be integrated in a well plug, which is initially closed, and which can be opened by increasing the pressure above the plug. Hence, no wireline run etc. is needed to open the plug.

The invention claimed is:

1. A well tool device comprising:

a housing;

a through bore provided axially through the well tool device; wherein the through bore is defined with a bore wall;

a frangible disc supported in the through bore by a first supporting device and a second supporting device, wherein the second supporting device is axially displaceable in relation to the first supporting device;

a shear element for preventing axial displacement of the second supporting device;

a sealing element arranged radially outside of the frangible disc and radially inside of the bore wall when the well tool device is in a first state, in which the sealing element together with the frangible disc is configured to prevent axial fluid flow between a first side the frangible disc and a second side of the frangible disc;

a disintegration device;

wherein the well tool device is configured to transition to a second state, in which the shear element has been sheared off and the frangible disc and the second supporting device have been moved axially until the frangible disc has been brought into contact with the disintegration device;

wherein the well tool device is configured to transition to a third state, in which the frangible disc has been disintegrated by means of the disintegration device;

the well tool device further comprises:

a flushing channel provided in the bore wall radially outside of the frangible disc when the well tool device is in the second state that forms a hydraulic connection between the first side and the second side of the frangible disc.

2. The well tool device according to claim 1, wherein the flushing channel is provided as at least one recess or groove in the bore wall.

3. The well tool device according to claim 2, wherein the at least one recess or groove is axially aligned with the disintegration device.

4. The well tool device according to claim 1, wherein the frangible disc is axially displaced to a position in which the sealing element is out of engagement with the frangible disc when the well tool device is in the second state.

5. The well tool device according to claim 1, wherein further axial movement of the second supporting device is prevented when the well tool device is in the third state.

6. The well tool device according to claim 5, wherein further axial movement of the second supporting device in the third state is prevented when an inner element of the shear element, formed by the shearing of the shearing element in the transition from the first state to the second state, is provided axially between, and in contact with, a stop and a receiving area.

7. The well tool device according to claim 5, wherein further axial movement of the second supporting device in the third state is prevented when a stop is provided in contact with a receiving area.

8. The well tool device according to claim 1, wherein the second supporting device is provided as part of an axially displaceable sleeve comprising a supporting surface contacting the disc when the disc is not disintegrated.

9. The well tool device according to claim 8, wherein the sleeve comprises a first stop and a second stop.

* * * * *